US005803332A

United States Patent [19]

Thompson

[11] Patent Number: 5,803,332

[45] Date of Patent: Sep. 8, 1998

[54] PACK WITH INTEGRATED SKI AND SNOWBOARD CUFF SYSTEM

[75] Inventor: Jesse B. Thompson, Bozeman, Mont.

[73] Assignee: K-2 Corporation, Vashon, Wash.

[21] Appl. No.: 890,256

[22] Filed: Jul. 9, 1997

[51] Int. Cl.[6] ..... A45F 5/00

[52] U.S. Cl. ..... 224/651; 224/580; 224/153; 224/250; 224/917

[58] Field of Search ..... 224/578, 579, 224/580, 153, 627, 628, 630, 633, 637, 640, 641, 642, 643, 644, 645, 650, 651, 257, 258, 250, 917

[56] References Cited

U.S. PATENT DOCUMENTS

| | | | |
|---|---|---|---|
| 268,932 | 12/1882 | Poirier . | |
| 995,458 | 6/1911 | Harriman | 224/651 |
| 2,224,568 | 12/1940 | Altofer . | |
| 4,518,107 | 5/1985 | Amos . | |
| 4,673,118 | 6/1987 | Kronz . | |
| 4,817,837 | 4/1989 | Grover | 224/250 |
| 4,819,845 | 4/1989 | Byrd . | |
| 4,972,981 | 11/1990 | Gex | 224/250 |
| 4,982,883 | 1/1991 | Ullal et al. . | |
| 5,318,209 | 6/1994 | Rader et al. | 224/250 |
| 5,350,096 | 9/1994 | Sieber . | |
| 5,450,991 | 9/1995 | Neading . | |
| 5,492,254 | 2/1996 | Challoner et al. . | |
| 5,540,364 | 7/1996 | Krieger et al. | 224/153 |
| 5,567,055 | 10/1996 | Smith | 383/38 |
| 5,647,522 | 7/1997 | Routh | 224/651 |

FOREIGN PATENT DOCUMENTS

| | | |
|---|---|---|
| 612489A1 | 8/1994 | European Pat. Off. . |
| 2 278 289 | 3/1976 | France . |
| 185702 | 8/1936 | Germany . |
| 167940 | 4/1951 | Germany . |

*Primary Examiner*—Allan N. Shoap
*Assistant Examiner*—Gregory M. Vidovich
*Attorney, Agent, or Firm*—Ronald M. Anderson

[57] ABSTRACT

A pack (10) for selectively carrying either relatively wide elongate articles, or relatively narrow elongate articles. The pack includes a bag (14) for carrying smaller articles internally. Near the top forward edge of the bag, shoulder straps **(16*a*, 16*b*) are attached, extending downwardly to attachment points adjacent the lower sides of the bag. A waistband (22) extends forwardly from each side of the pack. The waistband extends continuously around the rearwardly facing surface of the pack, forming webs (28, 30) that are attached to cuffs (32, 34). The cuffs are tapered, each having a slot (36,38) formed at its wider end where the cuff attaches to the bag. Similar cuffs (54, 56) are attached at their wider ends at opposite sides of the bag, near its top, and webs (46, 48) are attached to these cuffs. When the pack is used to carry a wider article, the cuffs overlap the surface of the article and the webs are connected with quick release buckles 40**, under tension, providing a compressive force against the cuffs to hold the article against the bag. When carrying one or more relatively narrow elongate articles such as skis, one or more of the cuffs is wrapped around the article(s) and the web attached to that cuff is passed through the slot of the cuff before being connected to the other web. Thus, either a snowboard or skis can be carried in a stable manner and rigidly held in place on the pack.

27 Claims, 2 Drawing Sheets

PACK WITH INTEGRATED SKI AND SNOWBOARD CUFF SYSTEM

FIELD OF THE INVENTION

The present invention generally relates to back pack apparatus for carrying articles, and more specifically, to a back pack that includes webbing to secure a snowboard, skis, or other equipment to be carried by a person.

BACKGROUND OF THE INVENTION

Wilderness travel on foot may require that a person cover both bare ground and snow-covered terrain. Over snow, a person will typically want to use either skis, a snowboard, or showshoes. However, such implements must be carried when not traveling on snow. Back country skiers/snowboarders also may at times need to pack into a site over bare terrain on which skis or a snowboard are not usable, but then will want to ski or snowboard down slopes that are covered with snow. Also, it is sometimes necessary to use snowshoes to climb up a slope and then switch to skis or a snowboard to ski down the slope. However, the skis or snowboard must be carried while on snowshoes or afoot, and the snowshoes must be carried when on the skis or snowboard.

Although skis or a snowboard can be carried by hand when traveling on foot or snowshoes, it is clearly preferable to carry them on a back pack, leaving the hands free for other purposes. A pack used for this purpose will also preferably include a bag or rucksack for carrying food, clothing, and other articles. Simply lashing the skis or snowboard to the back surface of a pack with simple straps is generally not an acceptable solution. Skis in particular, because of their length, can be difficult to secure when carried on a pack, so that they are stable and do not shift about or otherwise interfere with walking or climbing. A snowboard is relatively wide, compared to skis, and therefore, is often attached to a pack in a different manner than skis, using straps that are longer, and which attach to a pack in different locations than straps used to attach skis to a pack. It would be preferable to employ the same system for selectively attaching either skis or a snowboard to a pack. Also, any system used for carrying skis or a snowboard on a pack should enable the user to quickly couple skis or a snowboard to the pack and also quickly release them when they are needed.

The prior art includes several examples of packs designed to carry skis that are secured to a pack using simple straps. For example, U.S. Pat. No. 4,982,883 discloses a fanny pack with a shoulder harness for carrying skis and poles. The skis and poles are rigidly secured at two positions to the center of the fanny pack belt and are lashed to one of the shoulder harness straps using buckled straps that loop over the skis and the poles. The skis and poles are angled toward one side of the shoulder harness, clear of the back of the user's head. Relatively small compartments for carrying other items are attached to the waist belt, on each side of the positions where the skis and poles are attached. However, since the skis are mounted directly on the back surface of the fanny pack belt rather than on the back surface of a pack bag, it appears that they will be drawn too tightly into the small of the user's back and may rub on the user's shoulders and/or buttocks.

A more conventional rucksack with shoulder straps is disclosed in European Patent Publication No. 612,489A1. In this disclosure, a pair of skis are strapped together with their bottom surfaces contacting each other and are held to the back surface of the pack by a looped strap extending rearwardly from the bottom of the pack bag, and by a pair of elastic straps attached to the top of the bag that are coupled around the skis with a quick release buckle. This arrangement does not appear to provide the stability required for coupling the skis to the pack, and the skis are likely to shift about relative to the bag and the user's back.

FIG. 2 of U.S. Pat. No. 5,540,364 (Krieger et al.) shows a fanny pack with shoulder straps that are coupled to a snowboard. A waist strap extends around the fanny pack and the snowboard, compressing the bottom surface of the snowboard against the fanny pack. A web extends between the two shoulder straps at the user's back, and the ends of two straps pass through the shoulder straps and web and loop around the snowboard, before being buckled together, to compress the snowboard against the web and the shoulder straps. While this design seems to work well for a carrying a snowboard, it appears to be less useful for carrying skis.

Other prior art schemes for carrying skis or snowboards do not include a pack bag or compartments for carrying other items. For example, U.S. Pat. No. 4,673,118 shows a ski carrying pack that includes shoulder straps, which cross in an X at the middle of the user's back. Where the shoulder straps cross, a flexible wrapping strip is attached. This strip, which has two portions, is wrapped about a pair of skis secured with their bottom surfaces in contact, and two straps that are attached to the wrapping strip secure the strip around the skis using a fabric hook and loop fastening system. This scheme does not fully support the skis, since they are mounted to the shoulder strap at only one point instead of at two spaced-apart points. Accordingly, the skis can shift about the single mounting point, possibly striking the user in the head and generally interfering with travel.

Based on the foregoing discussion of related prior art, it will be apparent that a pack is needed that enables a user to selectively carry either skis or a snowboard. Further, the skis or snowboard should be held on the pack in a manner that ensures they are stable and do not cause discomfort to the user when carried on the pack. The pack should preferably include a bag sufficiently large to carry other articles. None of the prior art solutions for carrying skis or a snowboard seems to meet all of these needs.

SUMMARY OF THE INVENTION

In accord with the present invention, a pack for carrying an elongate article includes a panel of material forming a back of the pack and having opposite sides, a top, and a bottom. A pair of shoulder straps are attached to the panel, at points disposed adjacent its top and bottom. The pack also includes a waistband having two straps that are attached to a lower portion of the panel, with ends that extend forwardly of the panel. These ends are releasably coupled together to secure the waistband around a user's waist. A plurality of tapered cuffs are included on the pack, each having a wide end attached to the panel and a relatively narrower free end. The plurality of tapered cuffs include a first and a second tapered cuff disposed adjacent to the bottom of the panel and extending from opposite sides thereof. A slot opening is formed adjacent the wide end of at least one of the first and second tapered cuffs. Similarly, a third and a fourth tapered cuff are disposed adjacent to the top of the panel, extending from opposite sides thereof. Also, a slot opening is formed adjacent the wide end of at least one of the third and fourth tapered cuffs.

A plurality of compression webs extend in overlying relationship to the plurality of tapered cuffs. These compression webs include a first and a second compression web, each extending from the sides of the panel adjacent to the bottom of the panel and connected to the waistband. The first and second compression webs are releasably coupled together under tension to apply a compression force to the first and second tapered cuffs. In a like manner, a third and a fourth compression web are each attached to a corresponding one of the third and fourth tapered cuffs. The third and fourth compression webs are also releasably coupled together under tension to apply a compression force to the third and fourth tapered cuffs. The elongate article is thus held between the panel and the plurality of tapered cuffs, and the compression force applied by the plurality of compression webs secures the plurality of tapered cuffs around the elongate article to hold it in place on the pack.

One of the first and second tapered cuffs is adapted to wrap around and encircle the elongate article. The corresponding first or second compressor web is also adapted to wrap around and encircle the elongate article and the tapered cuff that is wrapped around it, pass through the slot, and couple to the other of the first and second compressor webs under tension, to apply the compression force. If two elongate articles are carried separately, the other of the first and second tapered cuffs and corresponding compressor web is adapted to wrap around the second elongate article in a similar manner. The first and second compressor webs are connected under tension to apply the compression force to the first and second tapered cuffs lo secure and hold the second elongate article. The same technique is used for one or both of the third and fourth tapered cuffs, and the corresponding compressor webs are similarly adapted to hold the elongate article (or two such articles) at the top portion of the pack.

Preferably, the elongate article comprises one of a snowboard and skis, but other elongate articles can also be carried by the pack. For example, snowshoes can be carried on the pack.

In one form of the invention, the first and second compressor webs comprise continuous extensions of the waistband. The plurality of tapered cuffs preferably comprise a material selected for its flexibility, strength, and its relatively high coefficient of friction. This material is exposed at least on inwardly facing surfaces of the plurality of tapered cuffs that contact the elongate article while it is being carried on the pack, thereby gripping the elongate article to prevent it from shifting about.

The first and second compressor webs preferably include a quick release connector for coupling them together with an adjustable tension, as do the third and fourth compressor webs.

One embodiment of the present invention also includes a bag for carrying other articles. In this case, the panel is a part of the bag. To provide strength and define a shape to the bag, an internal frame may be disposed within the bag. The elongate article may be carried aligned with the sides of the panel or may extend diagonally across the panel. If skis are carried, they may form a cross, so that each extends diagonally across the panel in opposite directions.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
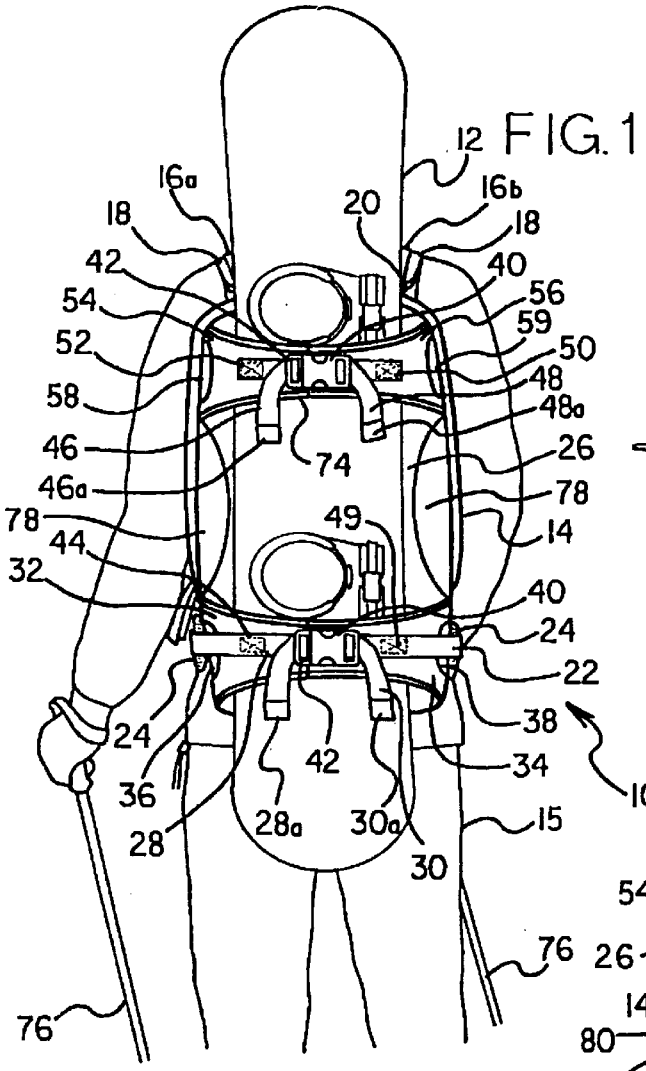
FIG. 1 is an elevational side view of a pack in accord with the present invention, while worn by a person, showing a snowboard attached to the back surface of the pack.
Figure 2:
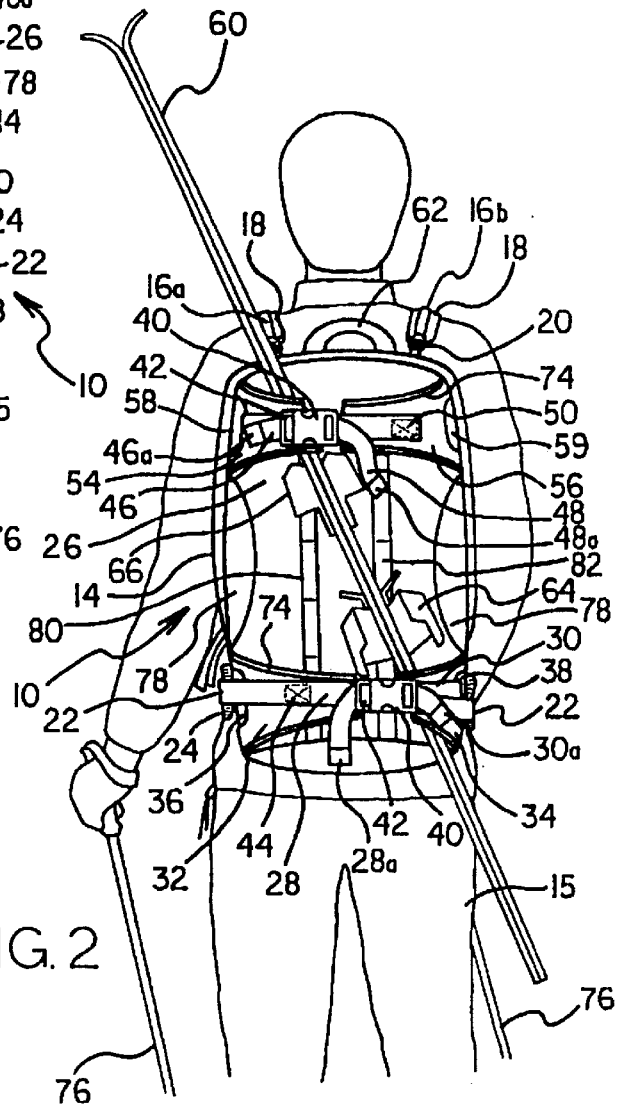
FIG. 2 is an elevational view of the rearwardly facing surface of the pack (in relationship to the orientation of the pack when worn by a person), showing skis secured diagonally across the rearwardly facing surface of the pack.

A pack 10 constructed in accordance with the present invention is illustrated in FIGS. 1 and 2. In FIG. 1, pack 10 is configured to carry a snowboard 12, which is a relatively wide article, whereas in FIG. 2, the pack is configured to transport skis 60. One of the features of pack 10 is its versatility in carrying either wide articles such as snowboard 12 and substantially narrower articles such as skis 60 so that in either case, the articles are well supported and rigidly attached to the pack.

The following description of the preferred embodiment of pack 10 generally applies to both FIGS. 1 and 2. Pack 10 includes a relatively shallow bag 14 having a zippered closure (not shown) extending around the top of the bag from just above waistband pads 24 that are attached along the sides, near the bottom of the bag. The bag can thus be used to carry objects that are inserted therein. Most of bag 10 is fabricated from a high denier NYLON™ fabric. However, a rearwardly facing surface 26 of bag 14, which is disposed between side panels 78, is fabricated of a strong, flexible material having a relatively high coefficient of friction. Preferably this material is a coated NYLON fabric sold under the trademark HYPALON.

When worn by a person 15, pack 10 is supported on the person's body by a left shoulder strap 16*a* and a right shoulder strap 16*b*. The shoulder straps connect to buckles 20, which are attached to the top forward edge of bag 14, and each includes an underlying pad 18 to distribute the load applied by pack 10 to the shoulders of the person wearing the pack. The lower end of shoulder straps 16*a* and 16*b* are connected to waistband pads 24, at opposite sides of the bag, along the top edges of the pads and adjacent to the front surface of the bag (i.e., the surface closest to the back of person 15).

A waistband 22 extends forwardly of the pack from both sides, wrapping around the person's waist and including two portions that connect with a buckle (not shown) in front. The length of waistband 22 is adjustable within this buckle, in a generally conventional manner, and once adjusted, is held in place by the friction of the waistband where it passes through the coupled portions of the buckle. Buckles of this sort are well known to those of ordinary skill in this art, and need not be shown to disclose the present invention.

Underlying the forward portion of waistband 22 on each side are the pads 24. The pads each extend from the forward sides of bag 14, and are approximately four inches in length, providing padding for supporting pack 10 on the hips of the person wearing the pack. The load of pack 10 is thus distributed between shoulder straps 16*a* and 16*b*, and waistband 22. Although not shown, bag 14 is supported by an internal frame have a padded forward surface. This internal frame includes a lightweight and flexible sheet that is covered with a high denier NYLON™ fabric. Padding (not shown) is provided on the front of the bag that contacts the user's back and shoulders, cushioning the internal frame.

Waistband 22 extends back around rearwardly facing surface 26 of bag 14, continuously extending to form webs 28 and 30, which are used for providing a compressive force to hold articles in place that are strapped to rearwardly facing surface 26. Ends 28*a* and 30*a* of webs 28 and 30, respectively, are folded over and sewn to prevent any unraveling of the NYLON™ material comprising the web and waistband. Web 28 (and the left part of waistband 22) is attached by a cross stitch patch area 44 to an underlying cuff 32, where the waistband transitions to web 28. A similar cross stitch patch area 43 attaches web 30 (and the right portion of waistband 22) to an underlying cuff 34 (see FIG. 2).

Cuff 32 and cuff 34 are each generally tapered in shape, each having a wide end that is attached to one side of bag 14, adjacent its bottom. Specifically, the wide end of cuff 32 is attached along the left side of bag 14, and the wide end of cuff 34 is attached along the right side of the bag. A slot 36 is formed through cuff 32 immediately adjacent to where it attaches to bag 14. Similarly, a slot 38 is formed in cuff 34, at its wide end, immediately adjacent to where it attaches to that side of bag 14. Cuffs 32 and 34 extend generally toward each other across rearwardly facing surface 26 of bag 14, and as shown in FIG. 1, overlap the surface of snowboard 12, compressing it against rearwardly facing surface 26 of bag 14. When connected together, the tension of webs 28 and 30 pulls cuffs 32 and 34 toward each other and applies a compressive force directed against the cuffs so that they in turn compress a relatively wide article such as snowboard 12 against rearwardly facing surface 26. Cuffs 32 and 34 are fabricated from a strong, flexible material having a characteristic high coefficient of friction so that the inner surface of the cuffs tend to "grab" when pressed against the surface of the article being carried on the pack. In a preferred embodiment, HYPALON material is used for fabricating the cuffs, although other materials of comparable strength, flexibility, and coefficient of friction could be used for this purpose.

To apply the compressive force to underlying cuffs 32 and 34, webs 28 and 30 are coupled together with a buckle 40 and a mating pronged insert 42, which is designed to engage buckle 40 and to snap in place therein. These two components thus form a quick release connector. Web 28 is threaded through pronged insert 42, and web 30 is threaded through buckle 40. However, either web can be threaded through the buckle or pronged insert with equivalent results. Buckle 40 and pronged insert 42 are generally conventional in design, and quick release connectors of this type are readily available, as will be well known to those of ordinary skill in this art. Like most such quick release connectors, buckle 40 and pronged insert 42 enable the length of web 28 and web 30 that is threaded therein to be adjusted so that the user can pull out the slack in the webs and apply an appropriate amount of tension, either before or after coupling pronged insert 42 within buckle 40. To apply the desired tension, the user simply grasps ends 28*a* and 30*a* of webs 28 and 30, respectively, and pulls in opposite directions. Further details of buckle 40 and pronged insert 42 are disclosed below.

Attached at the left side of bag 14, adjacent to its top, is the wide end of a cuff 54 that is generally tapered in shape, and has a slot 58. A similarly shaped cuff 56 is attached at its wide end to the right side of bag 14, adjacent to the top of the bag, and has a slot 59. Cuffs 54 and 56 extend across the rearwardly facing surface of bag 14 toward each other, and overlap the surface of a wide article such as snowboard 12, when it is attached to pack 10. A web 46 is attached to the outer surface of cuff 54 by a cross stitch patch 52, while a web 48 is attached to the outer surface of cuff 56 by a cross stitch patch 50. An end 46*a* of web 46 is folded over and stitched to prevent fraying; similarly, a free end 48*a* of web 48 is folded over and stitched.

Figure 3:
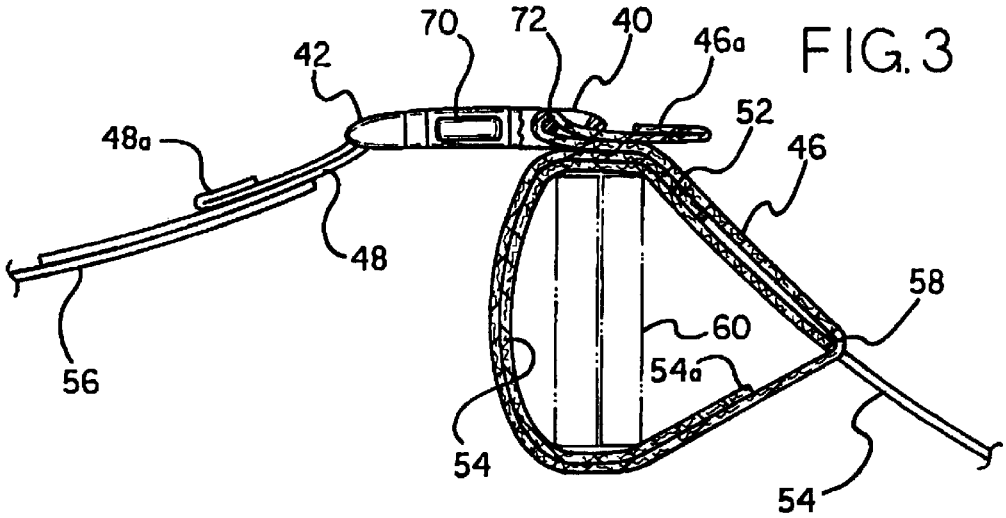
FIG. 3 is a cross-sectional view of the left top cuffs and the top compressor webs showing how the cuff and compressor web are wrapped around skis to secure them to the pack.
Figure 4:
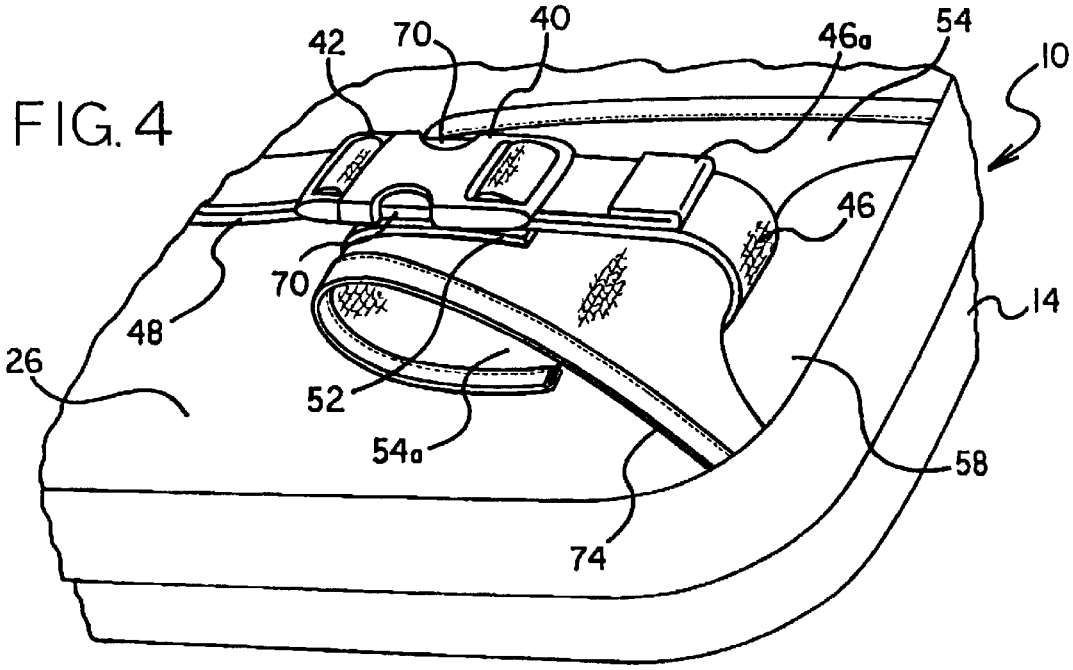
FIG. 4 is an isometric view of a portion of the upper left corner of the pack, showing the cuff and a portion of the compressor web that is looped through a slot in the cuff.

When connected under tension, a force is applied by webs 46 and 48 to cuffs 54 and 56, drawing the cuffs toward each other and applying a compressive force against rearwardly facing surface 26 of bag 14. To couple webs 46 and 48 together under tension, and to apply the required compression force against underlying cuffs 54 and 56, another quick release connector is employed. Web 46 is thus threaded through pronged insert 42 of this connector, and web 48 is threaded through buckle 40, which are then coupled together, as described above. The buckle and pronged insert can be threaded on the opposite webs with equivalent results (as shown in FIGS. 3 and 4).

By grasping ends 46*a* and 48*a* in each hand and pulling in opposite directions, the required tension can be applied to webs 46 and 48, after they are coupled together with buckle 40 and pronged insert 42 engaged. This action takes out the slack in the webs. Webs 28 and 30 and webs 46 and 48 might be referred to as "compressor webs" to more clearly indicate their function in providing a compressive force against the underlying cuffs. Cuffs 54 and 56 are preferably fabricated from HYPALON™ or other equivalent strong, flexible material having a relatively high coefficient of friction.

Although the compressive force and resulting friction of cuffs 54 and 56 and cuffs 32 and 34 against the surface of a wide article such as snowboard 12 should be sufficient to retain an article rigidly attached to the rearwardly facing surface of pack 14, it should also be noted that the bindings on snowboard 12 are disposed above cuffs 32 and 34, and above cuffs 54 and 56, as illustrated in FIG. 1. The bindings thus tend to prevent the snowboard from sliding downwardly through the cuffs.

Pack 10 enables an elongate and relatively wide, flat article such as snowboard 12 (or snowshoes) to be readily carried and retains the article in a stable position, preventing it from shifting about or coming detached from the pack. Buckles 40 and pronged inserts 42 are readily released from each other, enabling the snowboard or other article to be quickly removed from the pack. When necessary to again carry the article on the pack, the buckle and pronged insert can again be quickly reconnected.

Skis 60 and other such articles are relatively narrower than snowboard 12. Accordingly, pack 10 enables a different configuration of the cuffs and the webs to be used for holding such narrow articles rigidly in place on bag 14. Skis 60 or other narrow articles can be carried diagonally across the rearwardly facing surface of the bag as shown in FIG. 2, or may be carried vertically, positioned on either or both the left half or right half of rearwardly facing surface 26. Furthermore, although skis 60 are shown coupled together, with their bases toward each other as is typically done when carrying such articles, the skis can be split apart, and one carried on the left rearwardly facing surface of the pack, with the other carried on the right rearwardly facing surface of the pack. Or, the skis can be crossed in an "X" configuration and each attached diagonally across rearwardly facing surface 26. These and other modifications will be apparent from the following description of the configuration shown in FIG. 2, and further details shown in FIGS. 3 and 4.

FIGS. 3 and 4 illustrate how cuff 54 and web 46 are wrapped around relatively narrow elongate articles such as skis 60 so that web 46 applies a compressive force tending to hold the articles in place against rearwardly facing surface 26. Additional details of the cuffs are shown in these Figures. For example, the Figures show that an edge binding 74 is applied along the raw edges of each cuff to provide a finished appearance and prevent the cuffs from fraying.

The wrapped configuration of cuff 54 shown in these Figures is exemplary. A similar wrapped configuration of cuff 34 and web 30 is used at the lower right portion of pack 10, as illustrated in FIG. 2, to more rigidly attach skis 60 to pack 10 at that point. It will also be apparent that cuff 56 and web 48 can also be wrapped around a narrow elongate article in a similar fashion, as can cuff 32 and web 28.

In FIG. 3, cuff 54 extends over the edges of skis 60, passes the adjacent surface of the skis, and then wraps under the skis. Web 46 overlies cuff 54 and also wraps around the skis and the cuff, then passes through slot 58 and extends back over cross stitched patch 52, where web 46 is attached to cuff 54. The web is threaded around a pin 72 in buckle 40 and is held in place within the buckle due to the friction of the web surfaces against pin 72 and against each other. On the sides of buckle 40, prongs 70 are exposed (as best seen in FIG. 4), and when depressed, release pronged insert 42 from within buckle 40, allowing the two parts of the quick release connector to be detached from each other.

Since cuff 54 is looped around skis 60, more of its inner surface area comes into contact with the surface and edges of the skis. The coefficient of friction of the material comprising the cuff and the compression force provided by the web against the opposed sides and edges of the skis tends to rigidly hold the skis against rearwardly facing surface 26 of bag 14, which also has a relatively high coefficient of friction. The same benefit applies when any of the other cuffs and webs are looped around skis 60 or any other relatively narrow elongate article(s) being carried on pack 10. Since the user can quickly connect and disconnect buckles 40 and pronged inserts 42, skis 60 or other elongate relatively narrow articles can be immediately released and reattached to pack 10. Once attached in place, such articles are held in a stable and rigid manner so that they do not interfere with user when walking or climbing.

In FIG. 2, it will be apparent that heel bindings 64 are disposed immediately above cuffs 32 and 34, and extend above the top surface of the cuffs. Similarly, toe bindings 66 on skis 60 are disposed immediately below cuffs 54 and 56, and extend outside the enclosing surface of the cuffs. Accordingly, it will be apparent that these bindings tend to prevent any upward or downward movement of the skis relative to the cuffs, also thereby contributing to the rigid and stable support provided by the pack when carrying skis 60. It is also contemplated that ski poles 76 can be positioned against opposite outwardly facing surfaces of skis 60 and also encompassed within the wrap of the cuffs and webs so that they are also rigidly held in place with the skis when being carried on pack 10.

Certain features of pack 10 are more clearly visible in FIG. 2 than in the other Figures. Specifically, pack 10 includes a top loop 62 that can be used for attaching articles to the top surface of the pack, but more importantly, is provided for enabling the user to lift the pack when it is sitting on the ground by inserting the finger's of the user's hand through the loop. A further feature of pack 10 is provided by a pair of parallel straps 80 and 82 that are stitched to rearwardly facing surface 26 at spaced-apart intervals, thereby providing a series of connected loops through which other straps (not shown) can be used to attach smaller objects to bag 14. Pack 10 is thus versatile in its ability to carry a wide variety of articles both internally and attached to the rearwardly facing surface of the bag.

Most users will prefer to carry skis, a snowboard, or other elongate articles on a pack that includes a bag. However, it is also contemplated that rearwardly facing surface 26 need not be a back surface of a bag, but may instead be a correspondingly shaped padded panel to which the shoulder straps, waistband, cuffs, and webs are coupled. Thus, in this alternative embodiment, bag 14 would not be included, but substantially all other aspects of the embodiment described above that are not dependent upon having a bag that carries objects would still apply.

Although the present invention has been described in connection with the preferred form of practicing it, it will be understood by those of ordinary skill in the art that many modifications can be made thereto within the scope of the claims that follow. Accordingly, it is not intended that the scope of the invention in any way be limited by the above description, but that it be determined entirely by reference to the claims that follow.

The invention in which an exclusive right is claimed is defined by the following:

1. A pack for enabling a person to selectively carry either skis or a snowboard, comprising:

(a) a panel having a back surface facing away from the person when the pack is worn by the person;

(b) a pair of shoulder straps that are connected to the panel and adapted to support the pack at least partially on the person's shoulders;

(c) a first cuff for selectively securing one of the snowboard and the skis to the back surface of the panel, the first cuff having an end attached to a side of the lower portion of the panel and having a free end, a slot being formed through the end of the first cuff that is attached to the panel;

(d) a second cuff for selectively securing the one of the snowboard and the skis to the back surface of the pack, the second cuff having an end attached to a side of an upper portion of the panel and having a free end, a slot being formed through the end of the second cuff that is attached to the panel;

(e) a top compressor web attached to the second cuff, said top compressor web having a free end that is releasably coupled under tension to the panel to pull the second cuff so as to secure the second cuff around said one of the snowboard and the skis that is selectively carried on the pack; and (f) a bottom compressor web attached to the first cuff, said bottom compressor web having a free end that is releasably coupled under tension to the panel to pull the first cuff so as to secure the first cuff around said one of the snowboard and the skis that is selectively carried on the pack, said one of the snowboard and the skis being held by the first cuff and the second cuff to prevent shifting relative to the panel.

2. The pack of claim 1, wherein when used for selectively carrying the skis, the first cuff and the second cuff are adapted to wrap around the skis, said top compressor web wrapping around the second cuff and passing through the slot in said end of the of the second cuff to apply a compressive force thereto, and said bottom compressor web wrapping around the first cuff and passing the slot in said end of the first cuff to apply a compressive force thereto.

3. The pack of claim 1, wherein when used for selectively carrying the snowboard, the first cuff and the second cuff are adapted to overlie a surface of the snowboard, said top and bottom compressor webs respectively compressing said first and second cuffs against the snowboard and the snowboard against the back surface of the panel.

4. The pack of claim 1, further comprising a waistband that is connected to a lower portion of the panel and adapted to support the pack at least partially on the person's waist; wherein the bottom compressor web is coupled to the waistband, so that a compression force applied by the bottom compressor web is transmitted to the waistband.

5. The pack of claim 1, further comprising a top strap and a bottom strap, said top strap being coupled to the top portion of the panel on a side opposite that where the top compressor web is attached and said bottom strap being coupled to the bottom portion of the panel on a side opposite that where the bottom compressor web is attached; and a first and a second quick release buckle, wherein the bottom compressor web is connected to the bottom strap by the first quick release buckle, and the top compressor web is connected to the top strap by the second quick release buckle.

6. The pack of claim 5, wherein the first and the second quick release buckles each includes means for enabling adjustment and holding of the tension in the first and second web compressors, respectively.

7. The pack of claim 1, wherein the first and second cuffs have inwardly facing surfaces overlying the back surface of the panel, and wherein each of the first and second cuffs comprise a material on their inwardly facing surfaces having a relatively high coefficient of friction that is adapted to grip the skis and the snowboard when carried by the pack.

8. The pack of claim 1, wherein the panel defines a portion of a bag that includes a frame.

9. The pack of claim 1, further comprising a third cuff for selectively securing the one of the snowboard and the skis to the back surface of the panel, the third cuff having an end attached to a side of the lower portion of the panel opposite that where the first cuff is attached and having a free end, a slot being formed through the end of the third cuff that is attached to the panel; said bottom compressor web comprising two sections, one of the two sections being attached to the first cuff and another of the two sections being attached to the third cuff, said two sections each being coupled to an opposite side of the panel and being releasably connected together under tension to apply the compressive force that secures the one of the snowboard and the skis to the back surface of the panel.

10. The pack of claim 9, wherein when used for selectively carrying the skis, at least one of the first cuff and the third cuff is adapted to wrap around the skis, and is then compressed by the section of said bottom compressor web to which it is attached, by wrapping said section around the one of the first and the third cuff to which it is attached and passing the section through the slot formed in the end of said cuff to connect under tension to the other section of the bottom compressor web, to provide a compressive force that holds the skis to the back surface of the panel.

11. The pack of claim 1, further comprising a third cuff having an end attached to a side of the upper portion of the panel opposite that where the second cuff is attached and having a free end, a slot being formed through the end of the third cuff that is attached to the panel; said top compressor web comprising two sections, one of the two sections being attached to the second cuff and another of the two sections being attached to the third cuff, said two sections each being coupled to an opposite side of the panel and being releasably connected together under tension to apply a compressive force that secures the one of the snowboard and the skis to the back surface of the panel.

12. The pack of claim 11, wherein when used for selectively carrying the skis, at least one of the second cuff and the third cuff is adapted to wrap around the skis, and is then compressed by the section of said top compressor web, by wrapping said section around the one of the second and the third cuff to which it is attached and passing the section through the slot formed in the end of said cuff to connect under tension to the other section of the top compressor web, to provide a compressive force that holds the skis to the back surface of the panel.

13. The pack of claim 12, wherein one of the two sections of the top compressor web is attached to an intermediate point along a length of the second cuff, and the other of said two sections is connected to an intermediate point along a length of the third cuff.

14. The pack of claim 1, wherein the panel forms a portion of a bag for carrying other articles.

15. A pack for carrying an elongate article, comprising:

(a) a panel of material forming a back of the pack and having opposite sides, a top, and a bottom;

(b) a pair of shoulder straps that are coupled to the panel adjacent its top and bottom;

(c) a plurality of tapered cuffs attached to the panel, each tapered cuff having a wide end attached to a side of the panel and a relatively narrower free end, said plurality of tapered cuffs including:

(i) a first and a second tapered cuff disposed adjacent to the bottom of the panel and extending from opposite sides thereof, a slot being formed in the wide end of at least one of said first and second tapered cuffs;

(ii) a third and a fourth tapered cuff disposed adjacent to the top of the panel and extending from opposite sides thereof, a slot being formed in the wide end of at least one of said third and fourth tapered cuffs; and (d) a plurality of compression webs extending in overlying relationship to the plurality of tapered cuffs, said plurality of compression webs including:

(i) a first compression web and a second compression web, each extending generally from the sides of the panel, adjacent to the bottom of the panel, said first and second compression webs being releasably coupled together under tension to apply a compression force to said first and second tapered cuffs; and (ii) a third and a fourth compression web, each attached to a corresponding one of the third and fourth tapered cuffs, said third and fourth compression webs being releasably coupled together under tension to apply a compression force to said third and fourth tapered cuffs, said elongate article being disposed between the panel and the plurality of tapered cuffs, said compression force applied by the plurality of compression webs securing the plurality of tapered cuffs around the elongate article to hold it in place on the pack.

16. The pack of claim 15, wherein at least one of the first and second tapered cuffs is adapted to wrap around and encircle the elongate article, a corresponding one of the first and second compressor webs also being adapted to wrap around and encircle the elongate article and said at least one of the first and second tapered cuffs, pass through said slot, and couple to the other of the first and second compressor webs under tension, to apply the compression force.

17. The pack of claim 15, wherein one of the third and fourth tapered cuffs is adapted to wrap around and encircle the elongate article, a corresponding one of the third and fourth compressor webs also being adapted to wrap around and encircle the elongate article and said one of the third and fourth tapered cuffs, and to couple to the other of the third and fourth compressor webs under tension, to apply the compression force.

18. The pack of claim 15, wherein the elongate article comprises one of a snowboard and skis.

19. The pack of claim 15, further comprising a waist band that is coupled to a lower portion of the panel, wherein the first and second compressor webs comprise rearwardly directed extensions that are continuous with the waistband.

20. The pack of claim 15, wherein the plurality of tapered cuffs comprise a material selected for its flexibility, strength, and its relatively high coefficient of friction, said material being exposed at least on inwardly facing surfaces of the plurality of tapered cuffs that contact the elongate article while it is being carried on the pack, thereby gripping the article to prevent said article from shifting about relative to the plurality of tapered cuffs.

21. The pack of claim 15, wherein the first and second compressor webs include a quick release connect or for coupling them together with an adjustable tension, and wherein the third and fourth compressor webs include a quick release connector for coupling them together with an adjustable tension.

22. The pack of claim 15, further comprising a bag for carrying other articles, said panel comprising a part of the bag.

23. The pack of claim 22, further comprising an internal flexible and padded frame supporting the bag.

24. The pack of claim 15, wherein said plurality of compressor webs and said plurality of tapered cuffs are adapted to attach:

(a) the elongate article to the panel so that the elongate article extends diagonally across the panel;

(b) two elongate articles to the panel so that the elongate articles cross the panel diagonally;

(c) two elongate articles to the panel so that the elongate articles are parallel and extend vertically; or (d) the elongate article to the panel so that the elongate article extends vertically.

25. A pack for selectively carrying one of a relatively narrow elongate article and a relatively wider elongate article, comprising:

(a) a bag having a top, a bottom, a front, a rear, and sides;

(b) a pair of shoulder straps that are coupled to the bag to support it during use of the pack;

(c) a waistband coupled to a lower portion of the bag to support it during use of the pack;

(d) at first cuff attached at one end to a side of the bag, adjacent to the bottom of the bag;

(e) a second cuff attached at one end to a side of the bag opposite that to which the first cuff is attached, adjacent to the bottom of the bag, at least one of said first and second cuffs have a slot formed therein adjacent said one end;

(f) a third cuff attached at one end to a side of the bag, adjacent to the top of the bag;

(g) a fourth cuff attached at one end to a side of the bag opposite that to which the third cuff is attached, adjacent to the top of the bag, at least one of said third and fourth cuffs have a slot formed therein adjacent said one end;

(h) a first compressor web, extending from the side of the bag on which the first cuff is attached, and coupled to the waistband;

(i) a second compressor web, extending from the side of the bag on which the second cuff is attached, and coupled to the waistband;

(j) a third compressor web, coupled to the side of the bag on which the third cuff is attached and overlying the third cuff; and (k) a fourth compressor web, coupled to the side of the bag on which the fourth cuff is attached and overlying the fourth cuff, wherein to selectively attach the relatively narrow elongate article to the pack:

(i) one of the first and the second cuffs is looped around the relatively narrow elongate article;

(ii) a corresponding one of said first and second compressor webs is also looped around the relatively narrow elongate article, and passed through the slot in the corresponding cuff;

(iii) said first compressor web is releasably coupled under tension to said second compressor web, to apply a compressive force to said one of the first and second cuffs;

(iv) one of the third and the fourth cuffs is looped around the relatively narrow elongate article;

(v) a corresponding one of said third and fourth compressor webs is also looped around the relatively narrow elongate article, and passed through the slot in the corresponding cuff; and (vi) said third compressor web is releasably coupled under tension to said fourth compressor web, to apply a compressive force to said one of the third and fourth cuffs;

(l) and wherein to selectively attach the relatively wider article to the pack, the first and second cuffs and the third and fourth cuffs overlie the relatively wider article, and the first and second, and the third and fourth compressor webs are respectively coupled together under tension, to apply a compressive force to the third and fourth cuffs.

26. The pack of claim 25, wherein the first and second compressor webs are releasably coupled together with a connector that enables the tension in the first and second compressor webs to be adjusted, and the third and fourth compressor webs are releasably coupled together with a connector that enables the tension in the third and fourth compressor webs to be adjusted.

27. The pack of claim 25, wherein the first, second, third, and fourth cuffs are tapered from a relatively wider end that is attached to the sides of the bag, to a relatively narrow free end.

* * * * *